United States Patent [19]

Bulin et al.

[11] Patent Number: 5,020,941

[45] Date of Patent: Jun. 4, 1991

[54] BUOYANCY COMPENSATOR WITH DETACHABLE SHOULDER SECTION

[75] Inventors: Dennis G. Bulin, Wesley Chapel; Joseph P. James, Lutz, both of Fla.

[73] Assignee: Zeagle Systems, Inc., Zephyrhills, Fla.

[21] Appl. No.: 600,317

[22] Filed: Oct. 18, 1990

[51] Int. Cl.[5] ..... B63C 11/02

[52] U.S. Cl. ..... 405/186; 441/111

[58] Field of Search ..... 405/186, 187, 185; 441/108, 118, 111

[56] References Cited

U.S. PATENT DOCUMENTS

| | | | |
|---|---|---|---|
| 3,898,705 | 8/1975 | Schuler . | |
| 4,000,534 | 1/1977 | Cerniway et al. . | |
| 4,523,914 | 6/1985 | Faulconer et al. | 441/108 |
| 4,752,263 | 6/1988 | Pritchard et al. | 405/186 X |
| 4,778,307 | 10/1988 | Faulconer | 405/186 |
| 4,810,134 | 3/1989 | Faulconer et al. | 405/186 |
| 4,913,589 | 4/1990 | Faulconer et al. | 405/186 |
| 4,952,095 | 8/1990 | Walters | 405/186 |

*Primary Examiner*—Dennis L. Taylor
*Assistant Examiner*—J. Russell McBee
*Attorney, Agent, or Firm*—Dominik, Stein, Saccocio, Reese, Colitz & VanDerWall

[57] ABSTRACT

A vest assembly for supporting an air cylinder to the back of a scuba diver, comprising a vest to be worn about the person's torso including a back section for supporting the air cylinder, a waist band section having left and right side portions for removably affixing about the person's waist, and a detachable shoulder section for positioning over the person's shoulders. The detachable shoulder section may be replaced by another shoulder section of a different torso length so as to provide a comfortable fit of the vest to the height of the person's torso.

15 Claims, 2 Drawing Sheets

BUOYANCY COMPENSATOR WITH DETACHABLE SHOULDER SECTION

BACKGROUND OF THE INVENTION

1. Field of the Invention

This invention relates to buoyancy compensators for scuba divers. More particularly, this invention relates to buoyancy compensators comprising a vest fitted about the diver's torso for supporting a air cylinder and a bladder section connected to the back section of the vest for inflation with air from the air cylinder to achieve neutral buoyancy during diving.

2. Description of the Background Art

Presently there exists many types of buoyancy compensators designed to allow a scuba diver to achieve neutral buoyancy during diving. The earliest types of buoyancy compensators consisted of an inflatable bladder positioned in a life vest to be slipped over the diver's head and to lay against the diver's chest. An oral inflation tube was provided to orally inflate the buoyancy compensator to achieve neutral buoyancy during diving. As illustrated in U.S. Pat. Nos. 3,898,705 and 4,000,534, further improvements included providing a power inflater which inflated the bladder with air from the air cylinder. Unfortunately, life-vest styled buoyancy compensators tended to ride up the diver's chest and obstruct the diver's view and freedom of movement. To overcome this disadvantage, improved buoyancy compensators positioned the inflatable bladder in a backpack vest so that the vest, when inflated, would not obstruct the diver's view or freedom of movement (see U.S. Pat. No. 4,752,263).

As shown in U.S. Pat. Nos. 4,523,914, 4,778,307 and 4,810,134, another approach to minimizing the obstruction of the diver's view and freedom of movement included constructing the bladder in an integral suit-vest configuration with the bladder extending smoothly throughout the front and back sections of the vest. However, unlike backpack-styled buoyancy compensators, suit-vest configurations do not include a replaceable bladder that could be replaced in the event of damage or deterioration.

Currently, backpack-styled buoyancy compensators have been widely accepted in the trade and have been further improved to include a separate vest for fitting about the diver's torso to support the air cylinder and a bladder assembly connected to the vest. U.S. Pat. No. 4,913,589 illustrates one specific backpack-styled buoyancy compensator. In another, such as the one manufactured by the assignee of this invention, the separate vest further includes a cumberbund for a more comfortable fitting about the diver's waist.

Unfortunately, in all of the backpack-styled buoyancy compensators known to applicants herein that employ a vest for fitting about the diver's torso, the vests are manufactured in limited chest sizes (e.g. small, medium & large) and the only way for actually adjusting the vest to accurately fit the height of the diver's torso is by means of the adjustable shoulder straps. Thus, it can be readily appreciated that a tall diver with a thin waist and a stocky diver with a large waist may have the same chest size, but would preferably be fitted with a tall or torso-length vest and a short or torso-length vest, respectively. Hence, there exists a need in the market for a backpack-styled buoyancy compensator having a vest that is adaptable to tall, medium and short torso lengths.

Therefore, it is an object of this invention to provide an apparatus which overcomes the aforementioned inadequacies of the prior art devices and provides an improvement which is a significant contribution to the advancement of the buoyancy compensator art.

Another object of this invention is to provide a buoyancy compensator for supporting a air cylinder to the back of a scuba diver, comprising in combination a vest to be worn about the diver's torso, the vest including a back section for supporting the air cylinder, a waist band section having left and right side portions for removably affixing about the diver's waist, a shoulder section for removably affixing over the diver's shoulders comprising a horizontal portion, left and right shoulder portions extending substantially perpendicular from the horizontal portion, and means for removably fastening the horizontal portion of said shoulder section to an upper portion of the back section; an inflatable air bladder assembly fillable with air from the air cylinder; means for interconnecting the vest, the bladder assembly and the air cylinder; means for connecting the waist band section to the back-section; means for removably interconnecting the left and right side portions of the waist band section about the diver's waist; and means for removably interconnecting the left and right shoulder portions of the shoulder section to the left and right portions of the waist band section, whereby, the shoulder section may be replaced by another shoulder section of a different torso length so as to provide a comfortable fit of the vest to the height of the diver's torso.

Another object of this invention is to provide a buoyancy compensator as set forth hereinabove, wherein the means for removably fastening the horizontal portion to an upper portion of the back section comprises complementary hook and loop fasteners, one rigidly secured to the upper portion of the back section and the other rigidly secured to the horizontal portion of the shoulder section for removably fastening together.

Another object of this invention is to provide a buoyancy compensator as set forth hereinabove, wherein the hook and loop fasteners are each formed in a strip with the strips being sewn to the upper portion of the back section and to the horizontal portion of the shoulder section.

Another object of this invention is to provide a buoyancy compensator as set forth hereinabove, wherein the strips extend across the width of the upper portion of the back section and across the width of the horizontal portion of the shoulder section.

Another object of this invention is to provide a buoyancy compensator as set forth hereinabove, wherein the means for removably fastening the horizontal portion of the shoulder section to an upper portion of said back section comprises complementary belt and buckle fasteners, one rigidly secured to the upper portion of the back section and the other rigidly secured to the horizontal portion of the shoulder section for removably fastening together.

Another object of this invention is to provide a buoyancy compensator as set forth hereinabove, wherein the belt fastener is rigidly connected to the upper portion of the back section and the buckle fastener is rigidly connected to the horizontal portion of the shoulder section.

Another object of this invention is to provide a buoyancy compensator as set forth hereinabove, wherein a plurality of the complementary belt and buckle fasteners are rigidly connected to the upper portion of the back section and to the horizontal portion of the shoulder section.

Another object of this invention is to provide a buoyancy compensator as set forth hereinabove, further comprising a cumberbund for affixing about the diver's waist and means for removably connecting the cumberbund to the left and right portions of the waist band section of the vest.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a buoyancy compensator for supporting a air cylinder to the back of a scuba diver. More particularly, the buoyancy compensator of the invention comprises a vest to be worn about the diver's torso and an inflatable air bladder assembly interconnected to the vest by means of tank straps which rigidly secure the air cylinder to the vest in a backpack configuration. Preferably, the inflatable air bladder assembly comprises a horseshoe-shaped configuration positioned over the air cylinder with the sides of the air bladder assembly is positioned along the opposing sides of the air cylinder so as to not obstruct the diver's view or freedom of movement.

The vest of the buoyancy compensator of the invention comprises a back section which supports the air cylinder via the tank straps, a waistband section having left or right side portions for removably affixing about the diver's waist, and a shoulder section having a horizontal portion and left and right shoulder portions for positioning over the diver's shoulders to then be connected to the left and right portions of the waistband section.

Means are provided for removably fastening the horizontal portion of the shoulder section to an upper portion of the back section. While many types of fasteners may be utilized, the preferred embodiment of such fastener comprises hook and loop fasteners sewn to the horizontal portion of the shoulder section and to the upper portion of the back section in releasable engagement with each other. For added support, the preferred embodiment of the fastener may further comprise a plurality of belt and buckle fasteners with the belts rigidly secured to either the horizontal portion of the shoulder section or to the upper portion of the back section and the buckle rigidly secured to the other allowing the two sections to be removably buckled together.

The removability of the shoulder section from the back section allows shoulder sections of different torso lengths to be fitted to the back section so as to provide a comfortable and custom fit of the vest to the height of the diver's torso. For example, a diver having a tall torso height may be properly fitted with the vest by utilizing a shoulder section having a longer length. Conversely, a diver having a shorter torso height may be properly fitted with the vest by utilizing a shoulder section having a shorter length.

An ancillary feature of the buoyancy compensator of the invention having the detachable shoulder section is the ability to mix or match different colored back sections and shoulder sections to provide a more aesthetically pleasing and marketable buoyancy compensator.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in FIG. 1 is a perspective view of the buoyancy compensator of the invention having a detachable shoulder section.

Similar reference characters refer to similar parts throughout the several views of the drawings.

DETAILED DESCRIPTION OF THE PREFERRED EMBODIMENT

Figure 1:
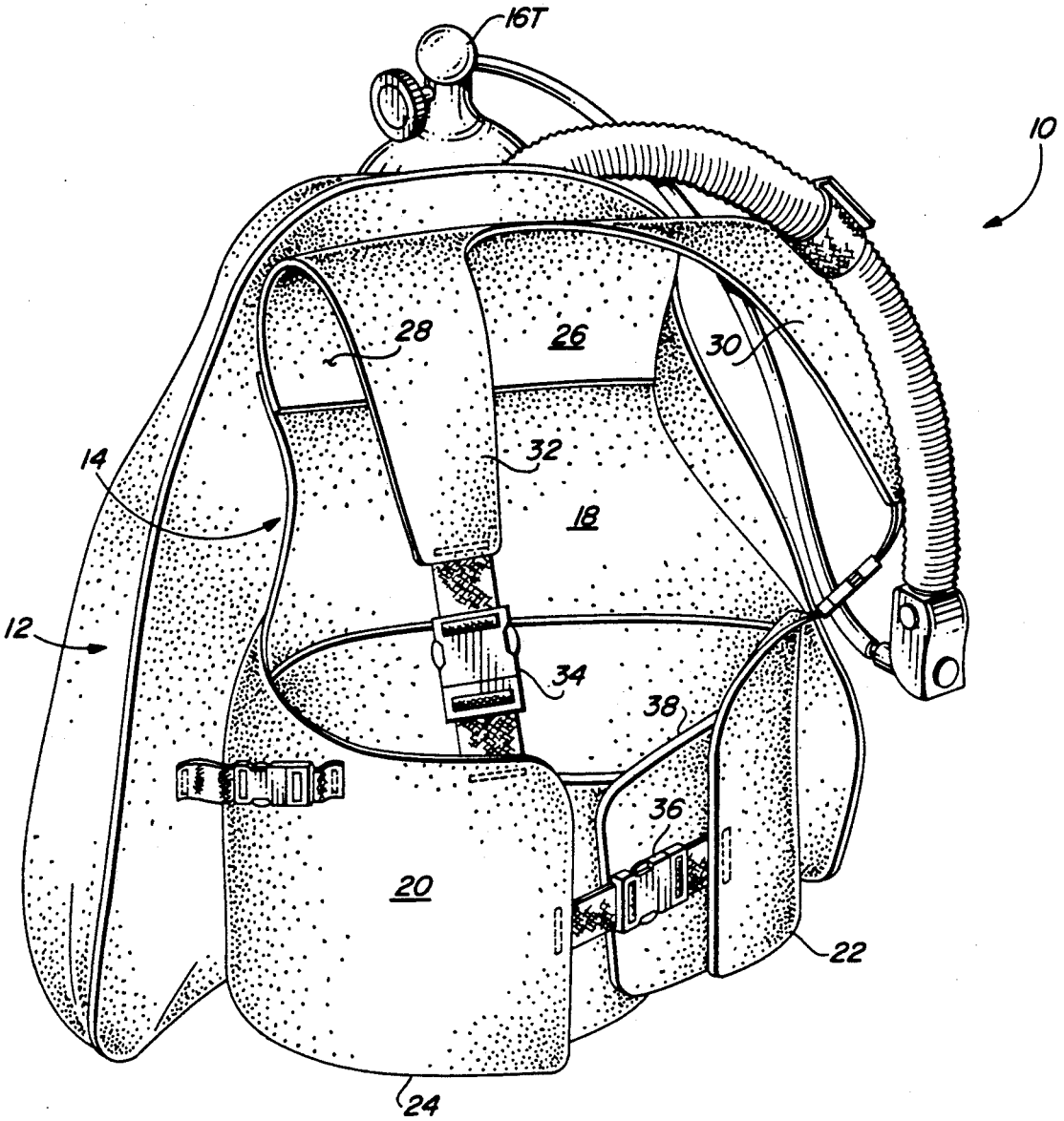

Referring to FIG. 1, the invention comprises a conventional horseshoe-shaped bladder assembly 12 connected to a vest 14 by means of a pair of tank straps 16 which rigidly secures a air cylinder (not shown) to the vest 12 in a backpack-styled configuration. The vest 14 comprises a back section 18, a waistband section 20 having left and right side portions 22 and 24, and a removable shoulder section 26 having a horizontal portion 28 and left and right shoulder portions 30 and 32. Conventional shoulder strap and buckles 34 interconnect the shoulder portions 30 and 32 with the side portions 22 and 24 of the waistband section 20. Similarly, a conventional waistband strap and buckle 36 interconnect the side portions 22 and 24 of the waistband section 20 with each other. A conventional cumberbund 38 may be fitted to the inside of the waistband section 20 for added comfort.

Figure 2:
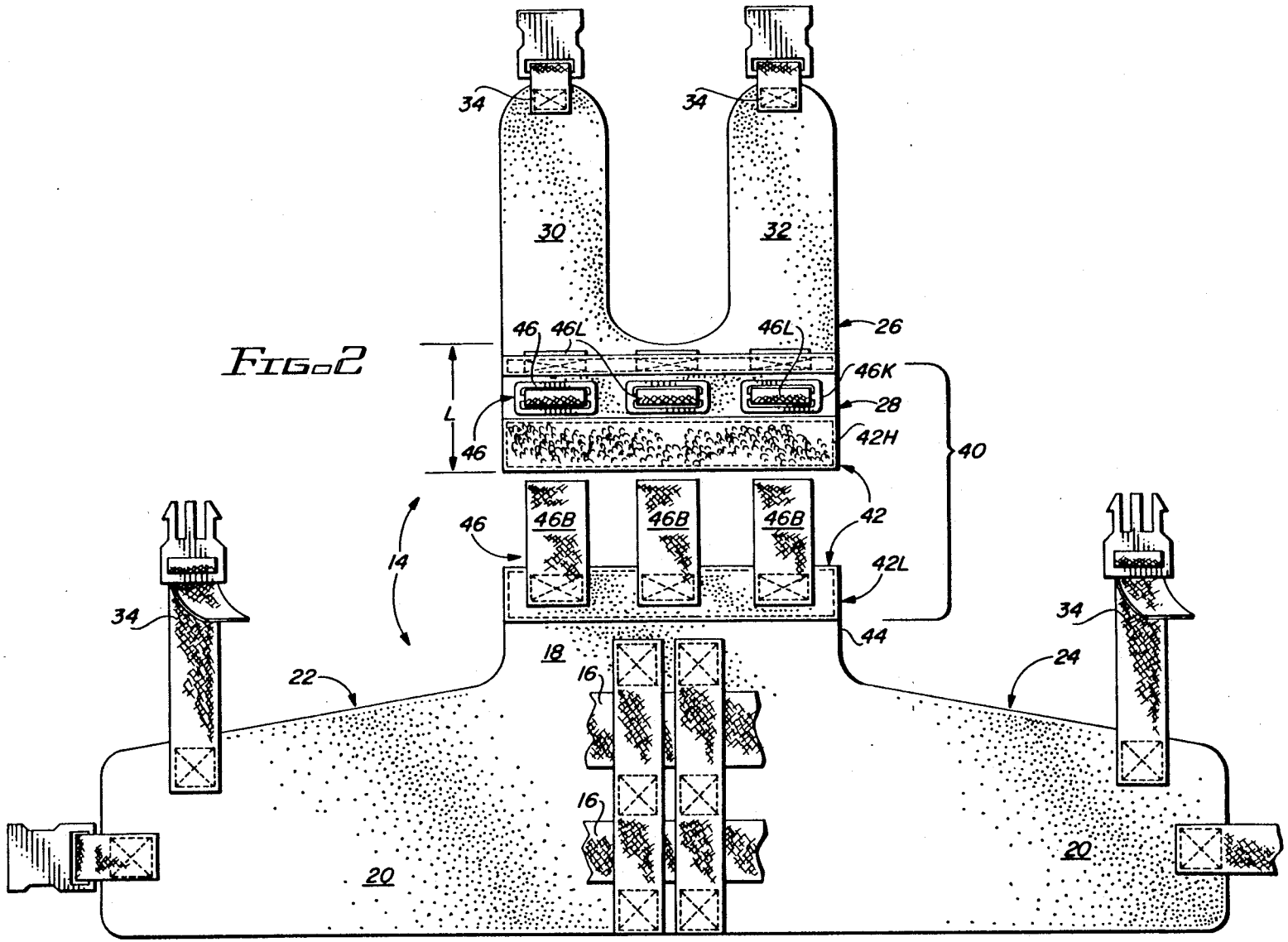
FIG. 2 is partially exploded view of the buoyancy compensator of the invention with the bladder assembly removed illustrating the interchangeability of different sized shoulder sections.

As shown in FIG. 2, fastener means, generally indicated by numeral 40 is provided for removably interconnecting the shoulder section 26 to the vest 14. More specifically, the fastener means 40 preferably comprises hook and loop fasteners 42 such as that sold under the registered trademark "Velcro". More preferably, hook and loop fasteners 42 are formed in strips with the hook fastener strip 42H sewn across the entire width of either the upper portion 44 of the back section 18 or to the horizontal portion 28 of the shoulder section 26 and the loop fastener component 42L being sewn across the entire width of the other.

Alternatively, or in combination with the hook and loop fasteners 42, the fastener means 40 may also comprise complementary belt and buckle fasteners 46. While many types of belt and buckle fasteners may suffice without departing from the spirit and scope of this invention, the preferred type of belt and buckle fasteners 46 comprises a belt 46B sewn to either the upper portion 44 of the back section 18 or to the horizontal portion 28 of the shoulder section 26 and a buckle 46K rigidly fastened to the other by means of a sewn-in loop 46L. As shown, most preferably, a plurality (e.g. 3) of such belt and buckle fasteners 46 are provided.

Figure 3:
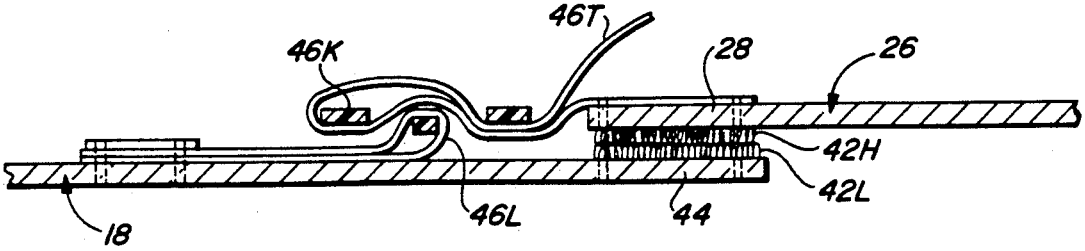
FIG. 3 is a cross-sectional view of FIG. 1 along lines 3—3 illustrating the interconnection of the shoulder section with the back section of the vest of the buoyancy compensator of the invention.

Referring also to FIG. 3, the shoulder section 26 for a specific torso length represented by dimension "L" (see FIG. 2), may be detachably secured to the back section 18 by overlapping the horizontal portion 28 of the shoulder section 26 with the upper portion 44 of the back section 18 so as to allow the hook fasteners 42H and the loop fasteners 42L to engage each other. The belts 46B may then be threaded through the buckles 46K with the trailing edge thereof 46T being further threaded back through the buckle 46K.

It should be quickly apparent that the detachability of the shoulder section 26 to the back section 18 of the vest 14 allows taller or shorter length shoulder sections 26 to be detachably secured to the back section 18 so as to custom fit the buoyancy compensator 10 of the invention to divers having taller or shorter torsos, respectively. In this regard, it should also be appreciated that the interchangeability of the shoulder section 26 allows the retailer to stock a large variety of colors of the back sections 18 (with waistband section 20), cumberbund 38, and shoulder sections 26 so as to allow mixing an matching of the colors as desired by the diver.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A diver's vest assembly for supporting a air cylinder to the back of a scuba diver, comprising in combination:

a vest to be worn about the diver's torso, said vest including a back section for supporting the air cylinder, a waist band section having left and right side portions for removably affixing about the diver's waist, a shoulder section for positioning over the diver's shoulders, comprising a horizontal portion and left and right shoulder portions extending substantially perpendicular from said horizontal portion and means for removably fastening said horizontal portion of said shoulder section to an upper portion of said back section;

means for interconnecting said vest and the air cylinder;

means for connecting said waist band section to said back section;

means for removably interconnecting said left and right side portions of said waist band section about the diver's waist; and means for removably interconnecting said shoulder portions of said shoulder section to said left and right portions of said waist band section, whereby, said shoulder section may be replaced by another shoulder section of a different torso length so as to provide a comfortable fit of said vest to the height of the diver's torso.

2. The diver's vest assembly as set forth in claim 1, wherein said means for removably fastening said horizontal portion to an upper portion of said back section comprises complementary hook and loop fasteners, one rigidly secured to said upper portion of said back section and the other rigidly secured to said horizontal portion of said shoulder section for removably fastening together.

3. The diver's vest assembly as set forth in claim 2, wherein said hook and loop fasteners are each formed in a strip, said strips being sewn to said upper portion of said back portion across the full width thereof and to said horizontal portion of said shoulder section across the full width thereof.

4. The diver's vest assembly as set forth in claim 3, wherein said strips extend across the width of said upper portion of said back section and across the width of said horizontal portion of said shoulder section.

5. The diver's vest assembly as set forth in claim 4, wherein said means for removably fastening said horizontal portion of said shoulder section to an upper portion of said back section further comprises complementary belt and buckle fasteners, one rigidly secured to said upper portion of said back section and the other rigidly secured to said horizontal portion of said shoulder section for removably fastening together.

6. The diver's vest assembly as set forth in claim 5, wherein said belt fastener is rigidly connected to said upper portion of said back section and said buckle fastener is rigidly connected to said horizontal portion of said shoulder section.

7. The diver's vest assembly as set forth in claim 5, wherein a plurality of said complementary belt and buckle fasteners are rigidly connected to said upper portion of said back section and to said horizontal portion of said shoulder section.

8. The diver's vest assembly as set forth in claim 5, further comprising a cumberbund for affixing about the diver's waist and means for removably connecting said cumberbund to said left and right portions of said waist band section of said vest.

9. The diver's vest assembly as set forth in claim 1, wherein said means for removably fastening said horizontal portion to an upper portion of said back section comprises complementary belt and buckle fasteners, one rigidly secured to said upper portion of said back section and the other rigidly secured to said horizontal portion of said shoulder section for removably fastening together.

10. The diver's vest assembly as set forth in claim 9, wherein said belt fastener is rigidly connected to said upper portion of said back section and said buckle fastener is rigidly connected to said horizontal portion of said shoulder section.

11. The diver's vest assembly as set forth in claim 10, wherein a plurality of said complementary belt and buckle fasteners are rigidly connected to said upper portion of said back section and to said horizontal portion of said shoulder section.

12. The diver's vest assembly as set forth in claim 9, wherein said means for removably fastening said horizontal portion of said shoulder section to an upper portion of said back section further comprises complementary hook and loop fasteners, one rigidly secured to said upper portion of said back section and the other rigidly secured to said horizontal portion of said shoulder section for removably fastening together.

13. The diver's vest assembly as set forth in claim 12, wherein said hook and loop fasteners are each formed in a strip, said strips being sewn to said upper portion of said back portion and to said horizontal portion of said shoulder section.

14. The diver's vest assembly as set forth in claim 13, wherein said strips extend across the width of said upper portion of said back section and across the width of said horizontal portion of said shoulder section.

15. The diver's vest assembly as set forth in claim 9, further comprising a cumberbund for affixing about the diver's waist and means for removably connecting said cumberbund to said left and right portions of said waist band section of said vest.

* * * * *